US012595653B1

(12) United States Patent
Wigboldy et al.

(10) Patent No.: US 12,595,653 B1
(45) Date of Patent: Apr. 7, 2026

(54) SEALING WALL FASTENER ASSEMBLY

(71) Applicant: Altenloh, Brinck & Co. US, Inc., Bryan, OH (US)

(72) Inventors: Jason R. Wigboldy, Grand Rapids, MI (US); Mitchell B. Mahler, Grand Rapids, MI (US); David A. Boyd, Grand Rapids, MI (US)

(73) Assignee: Altenloh, Brinck & Co. US, Inc., Bryan, OH (US)

( * ) Notice: Subject to any disclaimer, the term of this patent is extended or adjusted under 35 U.S.C. 154(b) by 346 days.

(21) Appl. No.: 18/298,007

(22) Filed: Apr. 10, 2023

Related U.S. Application Data

(63) Continuation-in-part of application No. 17/388,720, filed on Jul. 29, 2021, now Pat. No. 11,624,184, and
(Continued)

(51) Int. Cl.
*E04B 5/00* (2006.01)
*E04B 1/41* (2006.01)
(Continued)

(52) U.S. Cl.
CPC ..... *E04B 1/4178* (2013.01); *E04B 1/7616* (2013.01); *E04B 1/7633* (2013.01); *E04B 1/7637* (2013.01); *E04F 13/0833* (2013.01)

(58) Field of Classification Search
CPC .... E04B 1/4178; E04B 1/7616; E04B 1/7633; E04B 1/7637; E04F 13/0833
See application file for complete search history.

(56) References Cited

U.S. PATENT DOCUMENTS

D32,793 S 6/1900 Fauber
970,423 A 9/1910 Cunningham
(Continued)

FOREIGN PATENT DOCUMENTS

CA 2234485 A1 10/1999
CA 2690819 C 8/2012
(Continued)

OTHER PUBLICATIONS

Brochure disclosing 2" diameter Plasti-Grip® PBLP2 washer distributed by Rodenhouse Inc. more than one year prior to Sep. 6, 2012.

(Continued)

*Primary Examiner* — Basil S Katcheves
(74) *Attorney, Agent, or Firm* — Gardner, Linn, Burkhart & Ondersma LLP

(57) ABSTRACT

A wall fastener assembly for retaining an attachment such as a girt alongside or near a wall includes an elongated shank that provides space for at least one intermediate wall layer between the girt and a supportive member such as a stud. A center bore extends through the wall fastener assembly, and may receive a fastener for securing the wall fastener assembly to the wall. Once the wall fastener assembly is secured to the wall, a proximally-located flange and a distal end of the shank bottom-out on different surfaces to ensure the attachment is properly mounted to the wall, and a distally-located sealing portion engages with an intermediate wall layer to form a fluid barrier within the wall.

14 Claims, 8 Drawing Sheets

Related U.S. Application Data a continuation-in-part of application No. 16/859,764, filed on Apr. 27, 2020, now Pat. No. 11,698,095, and a continuation of application No. 16/661,438, filed on Oct. 23, 2019, now Pat. No. 11,078,663.

(60) Provisional application No. 62/838,425, filed on Apr. 25, 2019, provisional application No. 62/749,399, filed on Oct. 23, 2018.

(51) Int. Cl.
*E04B 1/76* (2006.01)
*E04F 13/08* (2006.01)

(56) References Cited

U.S. PATENT DOCUMENTS 1,108,922 A 9/1914 Menten
2,262,130 A 11/1941 Bagley
2,304,333 A 12/1942 Bossi
2,688,894 A 9/1954 Modrey
3,069,919 A * 12/1962 Schultz, Jr. ..... F16H 55/44 474/169
3,299,766 A 1/1967 Gould et al.
3,315,720 A 4/1967 Gutshall
3,389,525 A 6/1968 Moody
3,523,395 A 8/1970 Rutter et al.
3,828,493 A 8/1974 Vezmar
4,021,989 A * 5/1977 Hala ..... E04F 13/0855 52/378
4,102,239 A 7/1978 Dallas
4,114,597 A 9/1978 Erb
4,292,876 A 10/1981 De Graan
4,715,756 A 12/1987 Danico et al.
4,793,757 A 12/1988 Peterson
4,909,691 A 3/1990 Bögel
4,952,107 A * 8/1990 Dupree ..... F16B 5/0208 411/103
4,959,938 A * 10/1990 De Caro ..... F16B 31/02 411/413
5,079,055 A 1/1992 Doyle
5,275,519 A * 1/1994 Hainke ..... F16B 13/06 411/45
5,419,666 A 5/1995 Best
5,423,858 A 6/1995 Bolanos et al.
5,517,883 A 5/1996 Goldi et al.
5,541,377 A 7/1996 Stuhlmacher
5,569,005 A * 10/1996 Millington ..... F16B 19/1072 411/34
5,662,444 A * 9/1997 Schmidt, Jr. ..... F16B 41/002 411/533
5,671,578 A * 9/1997 Hohmann ..... E04B 1/4178 52/562
5,759,001 A * 6/1998 Smith ..... F16B 5/04 411/34
5,803,693 A 9/1998 Choiniere et al.
5,833,422 A 11/1998 Haga et al.
D410,869 S 6/1999 Singer
5,907,938 A 6/1999 Sheahan
6,039,525 A 3/2000 Johnson
6,212,841 B1 4/2001 Plume
6,231,063 B1 5/2001 Chi
6,582,171 B2 * 6/2003 Bondarowicz ..... F16B 21/18 411/525
6,585,468 B2 * 7/2003 Johnson ..... F16B 41/002 411/533
D482,270 S 11/2003 Derilo
6,665,991 B2 12/2003 Hasan
6,746,192 B2 * 6/2004 Eshraghi ..... F16B 19/1045 411/37
6,896,460 B2 * 5/2005 Enomoto ..... F16B 19/1081 411/41
D517,404 S 3/2006 Schluter
7,090,455 B2 8/2006 Lamb
D549,091 S 8/2007 McIntyre et al.
7,415,803 B2 8/2008 Bronner
7,416,362 B2 8/2008 North
D576,480 S 9/2008 Vakiener et al.
D596,934 S 7/2009 Vakiener et al.
7,640,707 B2 * 1/2010 Johnson ..... F16B 21/084 52/489.1
D634,248 S 3/2011 Chen
7,896,380 B2 3/2011 Tange
D644,921 S * 9/2011 Hsu ..... D8/399
D645,337 S 9/2011 Hsu et al.
8,037,653 B2 10/2011 Hohmann, Jr.
8,075,234 B2 * 12/2011 McClure ..... F16B 37/043 411/55
D660,691 S 5/2012 Yamazaki
D663,243 S 7/2012 Li
8,336,275 B2 12/2012 Rodenhouse
D679,169 S 4/2013 Else
D679,572 S 4/2013 Attaway
8,413,740 B2 4/2013 Rodenhouse
D682,666 S 5/2013 Wigboldy
8,516,763 B2 * 8/2013 Hohmann, Jr. ..... E04B 1/4178 52/383
8,517,649 B2 * 8/2013 Pratt ..... F16B 31/021 411/39
8,517,650 B2 * 8/2013 Niklewicz ..... B25B 31/005 411/57.1
8,555,596 B2 10/2013 Hohmann, Jr.
8,596,010 B2 12/2013 Hohmann, Jr.
8,601,763 B2 * 12/2013 Bui ..... E04B 1/41 52/422
8,613,175 B2 12/2013 Hohmann, Jr.
D696,930 S * 1/2014 Rodenhouse ..... D8/399
D696,931 S 1/2014 Rodenhouse et al.
D696,932 S 1/2014 Rodenhouse et al.
8,661,766 B2 * 3/2014 Hohmann, Jr. ..... E04B 1/4178 52/705
D702,544 S 4/2014 Hohmann, Jr.
8,726,597 B2 * 5/2014 Hohmann, Jr. ..... E04B 1/4178 52/513
D706,127 S 6/2014 Hohmann, Jr.
8,888,425 B2 * 11/2014 Pratt ..... F16B 19/1045 411/34
9,097,273 B2 * 8/2015 Branning ..... F16B 37/043
9,140,001 B1 9/2015 Hohmann, Jr.
D744,799 S 12/2015 Rodenhouse et al.
D748,973 S 2/2016 Rodenhouse et al.
D749,941 S 2/2016 Rodenhouse et al.
9,309,915 B1 4/2016 Rodenhouse et al.
D755,622 S 5/2016 Rodenhouse et al.
9,334,893 B2 * 5/2016 Schneider ..... F16B 19/1054
9,353,515 B2 5/2016 Farahmandpour
9,631,667 B2 4/2017 Rodenhouse et al.
D795,685 S 8/2017 Rodenhouse et al.
9,890,807 B1 2/2018 Rodenhouse et al.
9,945,414 B1 4/2018 Rodenhouse et al.
9,989,082 B2 6/2018 Rodenhouse et al.
10,151,103 B1 12/2018 Hohmann, Jr.
10,202,754 B2 2/2019 Hohmann, Jr.
10,876,285 B1 12/2020 Wigboldy et al.
11,078,663 B1 * 8/2021 Wigboldy ..... E04B 1/7633
11,698,095 B1 * 7/2023 Wigboldy ..... F16B 23/0007 411/371.2
2002/0098058 A1 7/2002 Caldera
2004/0060723 A1 4/2004 Pallapothu
2004/0084099 A1 5/2004 Miura
2005/0123372 A1 * 6/2005 Sato ..... F16B 5/0258 411/32
2005/0169726 A1 * 8/2005 McClure ..... F16B 37/043 411/55
2005/0207866 A1 * 9/2005 Attanasio ..... B64C 1/12 411/353
2006/0171794 A1 8/2006 Ordonio, Jr. et al.
2007/0011964 A1 1/2007 Smith
2007/0175170 A1 8/2007 Shah
2008/0115439 A1 5/2008 Tamlyn
2008/0145179 A1 6/2008 Amann et al.
2008/0310932 A1 12/2008 McIntyre et al.

(56) References Cited

U.S. PATENT DOCUMENTS

| | | | | |
|---|---|---|---|---|
| 2010/0019014 | A1 | 1/2010 | Rodenhouse | |
| 2010/0037552 | A1 | 2/2010 | Bronner | |
| 2012/0114448 | A1 | 5/2012 | Liu | |
| 2013/0247498 | A1 | 9/2013 | Hohmann, Jr. | |
| 2014/0260065 | A1 | 9/2014 | Hohmann, Jr. | |
| 2015/0176620 | A1* | 6/2015 | Koelner | E04B 1/76 411/55 |
| 2015/0247519 | A1* | 9/2015 | Call | F16B 25/0078 411/403 |
| 2016/0010325 | A1 | 1/2016 | Hohmann, Jr. | |
| 2016/0183638 | A1 | 6/2016 | Lu | |
| 2016/0215810 | A1 | 7/2016 | Echito et al. | |
| 2018/0172059 | A1 | 6/2018 | Hutchings et al. | |
| 2018/0240004 | A1* | 8/2018 | Gasser | E04B 1/7633 |
| 2019/0093697 | A1 | 3/2019 | Becker et al. | |
| 2019/0127970 | A1 | 5/2019 | Hohmann, Jr. | |
| 2019/0234448 | A1 | 8/2019 | Owens, II et al. | |

FOREIGN PATENT DOCUMENTS

| | | | |
|---|---|---|---|
| DE | 102007026733 | A1 | 12/2008 |
| EP | 1510629 | A1 | 2/2005 |
| WO | 2006114177 | A1 | 11/2006 |

OTHER PUBLICATIONS

Brochure disclosing 1-¾" diameter Plasti-Grip® CBW washer distributed by Rodenhouse Inc. more than one year prior to Sep. 6, 2012.

Brochure disclosing 1-¼" diameter Grip-Plate® Tab washer distributed by Rodenhouse Inc. more than one year prior to Sep. 6, 2012.

Brochure disclosing 1-¼" diameter Grip-Plate® Plastic washer distributed by Rodenhouse Inc. more than one year prior to Sep. 6, 2012.

Brochure disclosing 2" diameter Plasti-Grip® CBW2 washer distributed by Rodenhouse Inc. more than one year prior to Sep. 6, 2012.

Brochure disclosing 1-¾" diameter Plasti-Grip® III washer distributed by Rodenhouse Inc. more than one year prior to Sep. 6, 2012.

Brochure disclosing Plasti-Grip® PMF Plastic Masonry Fastener distributed by Rodenhouse Inc. more than one year prior to Sep. 6, 2012.

Brochure disclosing 3" diameter Grip-Lok® "Hurricane" washer distributed by Rodenhouse Inc. more than one year prior to Sep. 6, 2012.

Heckmann Building Products Inc.'s Catalog, Copyright 2001, Effective Jan. 2001; published in 2001.

* cited by examiner

SEALING WALL FASTENER ASSEMBLY

CROSS REFERENCE TO RELATED APPLICATIONS

The present application is a continuation-in-part of U.S. application Ser. No. 17/388,720 filed Jul. 29, 2021, which is a continuation of U.S. application Ser. No. 16/661,438, filed on Oct. 23, 2019, now U.S. Pat. No. 11,078,663, which claims the priority benefits of U.S. provisional applications Ser. No. 62/838,425, filed on Apr. 25, 2019, and Ser. No. 62/749,399, filed on Oct. 23, 2018, all of which are hereby incorporated herein by reference in their entireties. The present application is a continuation-in-part of U.S. application Ser. No. 16/859,764, filed on Apr. 27, 2020, which claims the priority benefit of U.S. provisional application Ser. No. 62/838,425, filed on Apr. 25, 2019, all of which are hereby incorporated herein by reference in their entireties.

FIELD OF THE INVENTION

The present invention is directed to a wall fastener assembly and wall attachment system, and in particular, energy efficient fastener assemblies for securing a wall attachment such as a track of girt that can be used to further secure an exterior surface or cladding system, for example brick or other masonry veneers or insulation attachments, to an insulated cavity wall or other wall system.

BACKGROUND OF THE INVENTION

Fasteners are used in building construction of wall systems, including for use in securing insulation over air, water, and/or vapor barriers, including threaded fasteners, such as screws, and non-threaded fasteners, such as nails. Threaded fasteners are also used with conventional brick or masonry anchors, such as for insulated cavity walls, such as in buildings utilizing veneer brick or masonry walls or insulated rainscreen walls. It may be desired to use one or more fasteners to secure an attachment such as a track of girt to a wall, in which an exterior veneer or cladding may then be secured to the attachment at a spaced distance away from the wall.

SUMMARY OF THE INVENTION

An embodiment of the present invention provides a wall anchor system or wall fastener assembly intended for securing in a fluid-sealed fashion one or more objects, structures, or wall attachments to a wall system. For example, the fastener assembly may be used to mount a cladding attachment, such as a furring channel, to a stud or other internal support member of the wall system, in which the wall system may include intermediate layers located between the furring channel and the stud, such as wall insulation, a fluid/vapor barrier or weather barrier, and gypsum sheathing. The fastener assembly has a bore for receiving a screw or other fastener, in which the bore extends through a shank located between a proximal portion having a flange and a distal portion having a fluid/vapor seal or sealing portion. After aligning the fastener assembly with a through hole in the furring channel, the screw may be inserted and driven through the bore and into the stud. The length of the shank is such that after driving the screw through the bore and a desired distance into the stud, the flange bottoms-out on the furring channel and the distal portion bottoms-out on the stud, thus reducing the risk of overdriving the screw into the stud and causing damage to one or more intermediate layers of the wall system. Furthermore, once the fastener assembly bottoms-out, the sealing portion may be positioned at a depth in the wall system to form a fluid-tight connection with the vapor barrier, thereby reducing fluid ingress through a hole formed in the vapor barrier by the fastener assembly. Thus, the fastener assembly allows a user to secure a wall attachment to a wall system via a fastener while also reducing the risk of overdriving the fastener and damaging the wall system, and preventing or reducing unwanted fluid/vapor/air ingress past an air, water, and vapor barrier in the wall system.

In one form of the present invention, a wall fastener assembly for securing a wall attachment to a wall system includes an elongated shank for providing a space for at least one intermediate wall layer between the wall attachment and a supportive member of the wall system. A flange is located at a proximal portion of the wall fastener assembly, and a sealing portion is located at a distal portion of the wall fastener assembly. A center bore extends along the length of the wall fastener assembly and may receive a fastener for securing the wall fastener assembly to the wall system. After the fastener has secured the wall fastener assembly to the wall system, the flange bottoms-out against an outer surface at or outboard of the wall system, the distal portion bottoms-out on the supportive member of the wall system, and the sealing portion engages with the at least one intermediate wall layer to form a fluid barrier.

In one aspect, the flange may be compressed against the outer surface when the wall fastener assembly is secured to the wall. Additionally, a fluid barrier may be formed between the flange and the outer surface when the wall fastener assembly is secured to the wall.

In another aspect, the shank and the flange are unitarily formed of a non-metallic material. Optionally, the sealing portion is unitarily formed with the shank and the flange.

In yet another aspect, the wall system includes an air, water, and vapor barrier and a gypsum layer that is located between the air, water, and vapor barrier and the supportive member. The sealing member may extend through the air, water, and vapor barrier and terminate within the gypsum layer when the fastener has secured the wall fastener assembly to the wall system.

In still another aspect, the wall attachment is a furring channel having a mounting flange that defines a mounting hole configured to receive the shank. When the wall fastener assembly is secured to the wall system, the flange is compressed between a portion of the fastener and the mounting flange, and substantially overlies the mounting hole. Optionally, the wall system also includes an insulation layer located between the furring channel and the air, water, and vapor barrier, in which the length of the shank is substantially equivalent to the combined thickness of the mounting flange, the insulation layer, the air, water, and vapor barrier, and the gypsum layer.

In a further aspect, the wall fastener assembly terminates in a frustoconical-shaped distal end having a diameter that is smaller than the diameter of the shank.

In still a further aspect, the bore is configured to receive a screw having a distal tapered end located opposite a screw head with a diameter larger than the bore. Optionally, when the wall fastener assembly is secured to the wall system, the screw head is located externally outboard of the wall fastener assembly, and the tapered end of the screw is located internally outboard of the wall fastener assembly.

In yet a further aspect, the sealing portion has a tapered wedge seal that extends circumferentially around the shank, in which a proximal wedge portion of the wedge seal has a diameter that is larger than a shank diameter. Optionally, when the wall fastener assembly is secured to the wall, the proximal wedge portion is located on an external side of the air, water, and vapor barrier, and a distal wedge portion is located on an internal side of the air, water, and vapor barrier.

In another form of the present invention, a wall fastener assembly for securing a veneer to a wall system includes an elongated, tubular shank, and a plurality of flanges spaced apart by a plurality of grooves, in which the flanges and the grooves are located at a proximal portion of the wall fastener assembly. A bore extends along the length of the wall fastener assembly and is configured to receive a fastener that is configured to secure the wall fastener assembly to a supportive member of the wall system. A cladding anchor is configured to be coupled to the wall fastener assembly at one of the plurality of grooves, and is also configured to be coupled to the veneer to thereby couple the veneer to the wall system via the wall fastener assembly. After the fastener has secured the wall fastener assembly to the wall system, at least one the flanges is configured to bottom-out against an outer surface of the wall system.

In one aspect, a sealing portion is located at a distal portion of the wall fastener assembly. The distal portion is configured to bottom-out on the supportive member of the wall system, and the sealing portion is configured to engage an intermediate wall layer of the wall system to form a fluid barrier at the intermediate wall layer.

In another aspect, the cladding anchor includes a bent wire having a throat portion that is configured to be coupled at one of the grooves. The cladding anchor may also be a bent plate having an inner securing portion that defines an opening configured receive one of the grooves to secure the cladding anchor to the wall fastener assembly, and an outer securing portion that defines a through hole configured to be disposed in a mortar joint while the cladding anchor is secured to the wall fastener assembly, in which the inner and outer securing portions are oriented at an angle relative to one another. Optionally, the cladding anchor may be a bent plate having an inner securing portion that defines an opening configured to receive one of the grooves to secure the cladding anchor to the wall fastener assembly, and an outer securing portion having a pair of legs that define an inner open area configured to be disposed in a mortar joint while the cladding anchor is secured to the wall fastener assembly.

In yet another form of the present invention, a girt attachment system for retaining girt alongside a wall system includes a track of girt comprising a mounting flange through which a mounting hole extends. Additionally, a wall fastener assembly includes a fastener for securing the wall fastener assembly to the wall system, an elongated and tubular shank, a flange located at a proximal portion of the wall fastener assembly, a sealing portion located at a distal portion of the wall fastener assembly, and a bore extending along the length of the wall fastener assembly for receiving the fastener. After the fastener has secured the wall fastener assembly to the wall system, the track of girt is disposed alongside the wall system and is secured to the wall system by the wall fastener assembly, the flange bottoms-out against the mounting flange, and the distal portion bottoms-out on an internal supportive member of the wall system, and the sealing portion engages with an intermediate wall layer of the wall system to form a fluid barrier. Optionally, the track of girt is a hat channel.

These and other objects, advantages, purposes and features of the present invention will become apparent upon review of the following specification in conjunction with the drawings.

DESCRIPTION OF THE PREFERRED EMBODIMENTS

Figure 1:
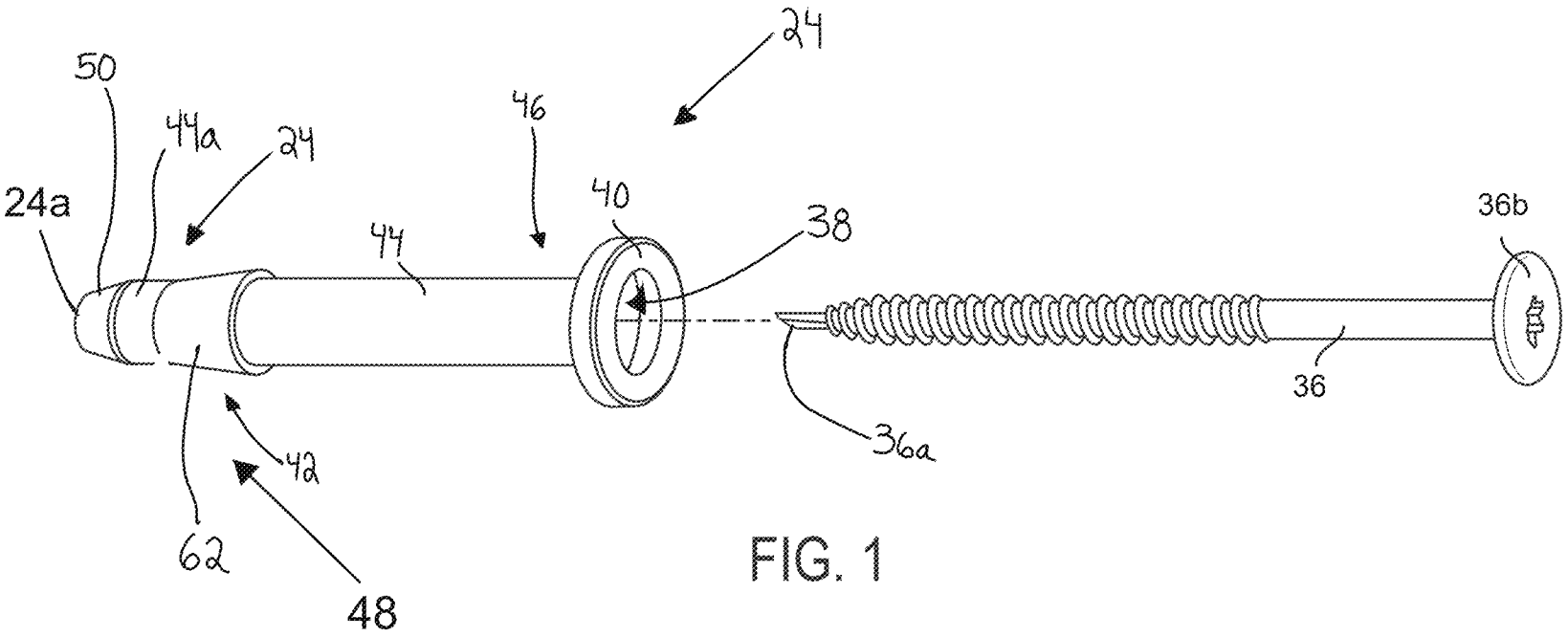
FIG. 1 is a perspective view of a wall fastener assembly in accordance with the present invention, shown with a threaded fastener.

Referring to the drawings and the illustrative embodiments depicted therein, exemplary wall system fastener assemblies for fastening or securing various wall coverings, claddings, and other wall attachments to wall systems are discussed herein. Wall coverings, claddings, and wall attachments may include various masonry veneers and girt systems. For example, with references to FIGS. 2-4, a girt, furring channel, or wall attachment in the form of a hat channel 20 is shown secured to a wall system 22 via a wall fastener assembly 24. As shown in the illustrated embodiment, wall system 22 includes a weather barrier or air, water, and vapor barrier/sheet in the form of weather barrier 26 which provides a seal to block or inhibit fluids such as liquid water and water vapor from penetrating or moving inward further into wall system 22. Wall system 22 also includes an internal supportive member in the form of a stud 28, a layer of gypsum 30 that is located between barrier 26 and stud 28, and an outer layer of thermal insulation 32. As noted above, wall fastener assembly 24 can be used to secure hat channel 20 to wall system 22, in which an exterior veneer or cladding may then be secured or mounted to hat channel 20. Hat channel 20 includes a series of mounting holes 34 through which wall fastener assembly 24 may be inserted. Once inserted, a screw 36 or other fastener may then be inserted and/or driven through a central bore 38 extending through wall fastener assembly 24 until screw 36 extends past a distal end 24*a* of wall fastener assembly 24 and into stud 28 to thereby secure hat channel 20 alongside wall system 22. As screw 36 is driven into stud 28, a flange 40 of wall fastener assembly 24 bottoms out against hat channel 20, while distal end 24*a* bottoms out against stud 28, thus ensuring screw 36 is driven a preferred distance into stud 28. At the same time, a sealing portion 42 is located on wall fastener assembly 24 such that sealing portion 42 engages with barrier 26 in a fashion so as to maintain the integrity of barrier 26.

Hat channel 20 includes a pair of mounting portions or flanges 52*a*, 52*b* that are configured to mount substantially flat along the face of insulation layer 32. Mounting holes 34 are spaced uniformly along the length of mounting flanges 52*a*, 52*b*, and extend through mounting flanges 52*a*, 52*b* to provide locations for receiving a plurality of wall fastener assemblies 24 to secure hat channel 20 to wall system 22. The elongate outer edges of the mounting flanges 52*a*, 52*b* may be chamfered, rounded or eased so as to inhibit tearing of insulation layer 32. Hat channel 20 additionally includes a plurality of ventilation holes 54 along a pair of elongate legs 56*a*, 56*b* that provide locations for drainage or ventilation as necessary. For example, ventilation holes 54 may be uniformly spaced at one inch (1") intervals along the legs 56*a*, 56*b*. Hat channel 20 provides a location at which additional cladding or building materials can be secured to wall system 22, such as to optional face holes 64 of elongate face 58 (FIG. 3) or to legs 56*a*, 56*b*. For example, cladding systems such as for vinyl siding, lathe applications, or the like may be mounted or secured to wall system 22 via one or more hat channels 20. A pair of ribs 66*a*, 66*b* run along opposing sides of face 58 to further strengthen hat channel 20. It should be appreciated that various characteristics of a hat channel or other furring channel or attachment may vary. For example, a hat channel could include legs that extend away from a wall system at a distance that is greater or lesser apart from what is shown in the illustrated embodiment. Furthermore, a hat channel may include more or less mounting holes, ventilation holes, and/or face holes, and the various holes that do extend through a hat channel may be spaced differently and may also be shaped differently. Additionally, a furring channel could take alternative forms including a C-shaped channel, a J-shaped channel, a Z-shaped channel, or a substantially flat channel or member.

With further reference to FIG. 1, wall fastener assembly 24 includes an elongated tubular shank 44 through which bore 38 extends. In the illustrated embodiment, shank 44, flange 40, and sealing portion 42 are integrally or unitarily formed of a rigid non-metallic material, for example, polycarbonate, polyurethane, or a similar polymer or co-polymer. However, it should be appreciated that one or more of these components may be separately formed, and may be formed of a metallic material. Flange 40 is located at a proximal portion 46 of wall fastener assembly 24, and includes an outer flange diameter that is larger than an outer shank diameter 44*b* of shank 44, and is also larger than the diameter of mounting holes 34. Sealing portion 42 is located at a distal portion 48 of wall fastener assembly 24, and has a tapered or wedge-shaped geometry that enables it to penetrate through various intermediate layers 60 of wall system 22 (which include insulation layer 32, weather barrier 26, and gypsum layer 30) and to create a fluid seal/barrier between wall fastener assembly 24 and weather barrier 26. That is, sealing portion 42 may form a fluid seal/barrier that prevents fluids including air, water, water vapor, and other fluids and/or vapors and gasses, from passing between or past wall fastener assembly 24 and weather barrier 26. Shank 44 may be formed of a rigid non-metallic material with an elongated tubular construction and a center bore 38 running along the length of the shank 44. Wall fastener assembly 24 terminates distally in a frustoconical-shaped tapered portion 50 that is located at distal portion 48. The tapered cone shape of tapered portion 50 enables wall fastener assembly 24 to more easily penetrate intermediate layers 60 of wall system 22 in a fashion that minimizes damage to intermediate layers 60.

Flange 40 is generally disc-shaped and is configured to constrain the movement of wall fastener assembly 24 relative to wall system 22, and also to constrain the movement of screw 26 relative to wall fastener assembly 24. Specifically, as a threaded and tapered screw end 36*a* of screw 36 is driven into stud 28, a screw head 36*b* of screw 36 is pulled into contact with a proximal surface 40*a* of flange 40. Screw head 36*b* has a larger diameter than that of bore 38 of wall fastener assembly 24, and is thus prevented or inhibited from entering or being received by bore 38. Accordingly, as screw 36 is tightened, screw head 36*b* compresses against flange 40 to thereby compress and sandwich flange 40 between an outer surface of mounting flange 52*a* and screw head 36*b*, such that proximal surface 40*a* of flange 40 engages with screw head 36*b*, and a distal surface 40*b* of flange 40 engages with mounting flange 52*a*. Flange 40 may be deformed as it is compressed in this fashion to form a fluid-tight barrier between screw head 36*b* and mounting flange 52*a*. Flange 40 is rigid enough to maintain sufficient structural integrity as it bottoms-out against mounting flange 52*a* to thereby prevent wall fastener assembly 24 from being pulled or forced through mounting hole 34. As such, flange 40 provides a counteractive force to inhibit screw 36 from being overdriven into wall system 22, thus reducing the likelihood of screw 36 from damaging wall system 22. It should be appreciated that a flange may have varying thicknesses and varying diameters. For example, a flange may have an increased thickness to increase its rigidity and/or strength to thus reduce the extent of deformation and crushing of the flange when the flange bottoms-out. A flange may also have a larger or smaller diameter to allow a wall fastener assembly to accommodate mounting holes of different shapes or sizes.

Figure 4:
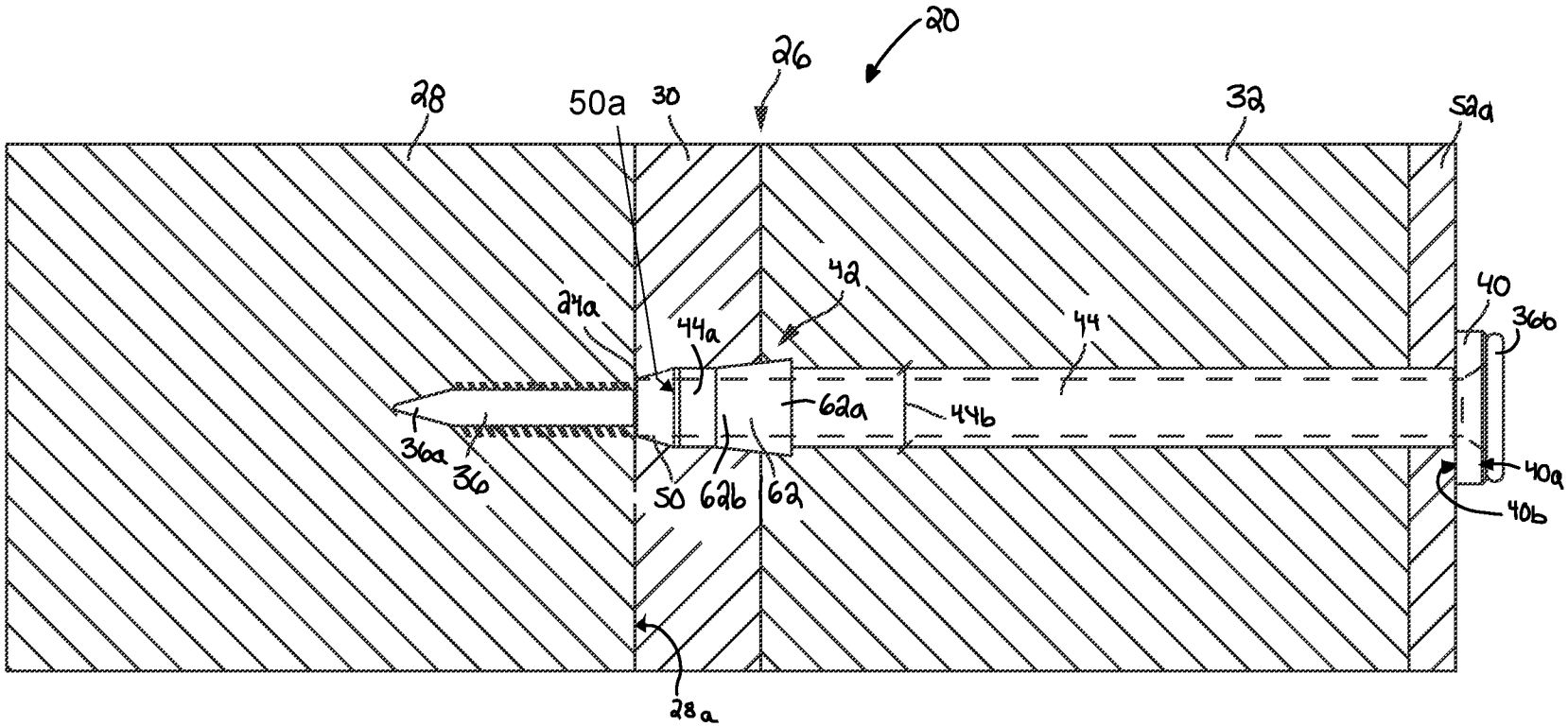
FIG. 4 is a cross sectional side elevation view of the wall fastener assembly and girt of FIG. 2.

With particular reference to the illustrated embodiment of FIG. 4, shank 44 has a shank length that is substantially equivalent to that of mounting flange 52*a*, insulation layer 32, weather barrier 26, and gypsum layer 30. Therefore, the length of shank 44 is such that distal end 24*a* of wall fastener assembly 24 will bottom-out against stud 28 at approximately the same time that flange 44 bottoms-out against mounting flange 52*a*, as previously described. Accordingly, the risk against overdriving screw 36 is further reduced, as both flange 44 and distal end 24*a* each simultaneously bottom-out against surfaces once screw 36 has been driven into stud 28 an optimal or preferred distance. Additionally, a hole created by screw 36 as it passes through stud 28 is sealed and/or covered by distal end 24*a* as distal end 24*a* bottoms out against an exterior or outer surface 28*a* of stud 28. In that regard, distal end 24*a* may compress and/or deform to create a fluid-tight barrier between wall fastener assembly 24 and stud 28. It should be appreciated that a shank is preferably selected to closely match a combined thickness of one or more intermediate wall layers plus the thickness of a mounting flange or similar attachment feature, if applicable. Therefore, an alternative wall fastener assembly may have a shank length that is greater or lesser than that of shank 44. Additionally, a shank may have a diameter that is larger or smaller apart from what is shown in the illustrated embodiment in order to accommodate larger or smaller bores for receiving different types of fasteners, or to increase the wall thickness of a shank to increase the strength and rigidity of the shank.

As previously noted, distal portion 48 of wall fastener assembly 24 includes sealing portion 42 and tapered portion 50 that terminates at distal end 24*a*. Distal portion 48 is located on a penetrating side or end of wall fastener assembly 24—opposite proximal portion 46 located on a non-penetrating side or end of wall fastener assembly 24—and is drivable through intermediate wall layers 60 of wall system 22. A proximal end 50*a* of tapered portion 50 has a diameter that is equivalent to shank diameter 44*b*, in which the diameter of tapered portion 50 gradually decreases distally such that at distal end 24*a*, the diameter of tapered portion 50 is less than that of shank diameter 44*b*, and is only slightly larger than central bore 38. The sharpened or pointed geometry of tapered portion 50 enables wall fastener assembly 24 to cut or pierce through intermediate layers 60 rather than auguring through intermediate layers 60 to thereby lessen or mitigate damage to intermediate layers 60 during installation of wall fastener assembly 24 to wall system 22. Alternative tapered portions may be longer or shorter, and may have a tapered geometry that is more aggressively or gradually tapered apart from what is shown in the illustrated embodiment.

A distal shank portion 44*a* is located between tapered portion 50 and sealing portion 42, and is of a length that properly positions sealing portion 42 within wall system 22 such that sealing portion 42 can engage with weather barrier 26 to form a fluid-tight seal between wall fastener assembly 24 and weather barrier 26. An alternative wall fastener assembly may include a distal shank portion that is shorter or longer than distal shank portion 44*a*, or may include no distal shank portion at all depending on the optimal location of a sealing portion on a shank, which is determined based on the characteristics of a wall system that a wall fastener assembly is to be secured to. Specifically, the length of a distal shank portion should be such that a sealing portion is located on a shank to engage a fluid barrier once a flange and/or distal end of a wall fastener assembly has bottomed-out. It should be appreciated that a tapered portion could take the place of a distal shank portion, such that a shank would have a continuous taper between a distal end of a sealing portion and a distal end of a wall fastener assembly.

Sealing portion 42 has a frustoconical, or tapered geometry in the form of wedge gasket or seal 62, and is positioned towards and/or incorporated into or at a distal portion 48 of wall fastener assembly 24 to provide an air, fluid, and/or vapor seal between wall fastener assembly 24 and weather barrier 26. Wedge seal 62 extends around shank diameter 44*b* and includes a wide portion or proximal wedge portion 62*a* having a proximal wedge diameter that is larger than shank diameter 44*b*, and is tapered inwardly toward shank 44 towards a distal wedge portion 62*b*, or relative to the insertion direction of wall fastener assembly 24 into wall system 22. That is, the proximal wedge portion 62*a* is wider than distal wedge portion 62*b*. In the illustrated embodiment, distal wedge portion 62*b* terminates in a diameter that is equal to shank diameter 44*b*.

As noted above, edge seal 62 is positioned and/or shaped along the length of shank 44 based on the location of weather barrier 26, and is located such that when wall fastener assembly 24 is secured to wall system 22, proximal wedge portion 62*a* is located on an external or outer side of weather barrier 26, and distal wedge portion 62*b* is located on an internal or inner side of weather barrier 26. In the illustrated embodiment, weather barrier 26 is affixed to an external or outer side of gypsum layer 30, in which gypsum layer 30 is secured to stud 28. Therefore, the location of wedge seal 62 along shank 44 in the illustrated embodiment is primarily determined by the thickness of gypsum sheathing 30. As a result, wedge seal 62 is positioned at weather barrier 26 when distal end 24*a* of wall fastener assembly 24 is pressed against or bottoms-out against stud 28.

Due to the wedge/conical shape of wedge seal 62 described above, a fluid and/or vapor seal is created and maintained between wedge seal 62 and weather barrier 26 as screw 36 is driven into stud 28. This is because the tapered or wedge shape of wedge seal 62 causes wedge seal 62 to wedge and compress itself into/through weather barrier 26 as wall fastener assembly 24 is driven into/through intermediate layers 60 of wall system 22. Accordingly, the hole created through weather barrier 26 due to the insertion of wall fastener assembly 24 is substantially equivalent to the outer diameter of wedge seal 62 located adjacent weather barrier 26, such that a tight or close-fitting connection or coupling is formed and/or maintained between the outer surface of wedge seal 62 and weather barrier 26. As such, the integrity of weather barrier 26 to prevent or inhibit vapors and/or fluids from passing further into wall system 22 is maintained.

Figure 2:
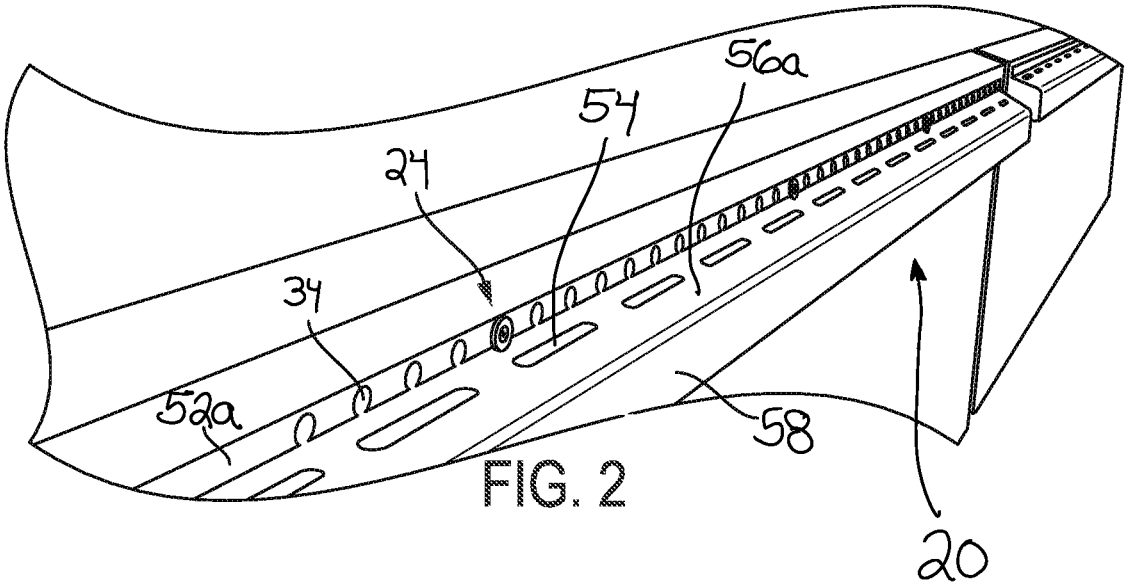
FIG. 2 is perspective view of the wall fastener assembly of FIG. 1 shown securing a girt to a wall system.
Figure 3:
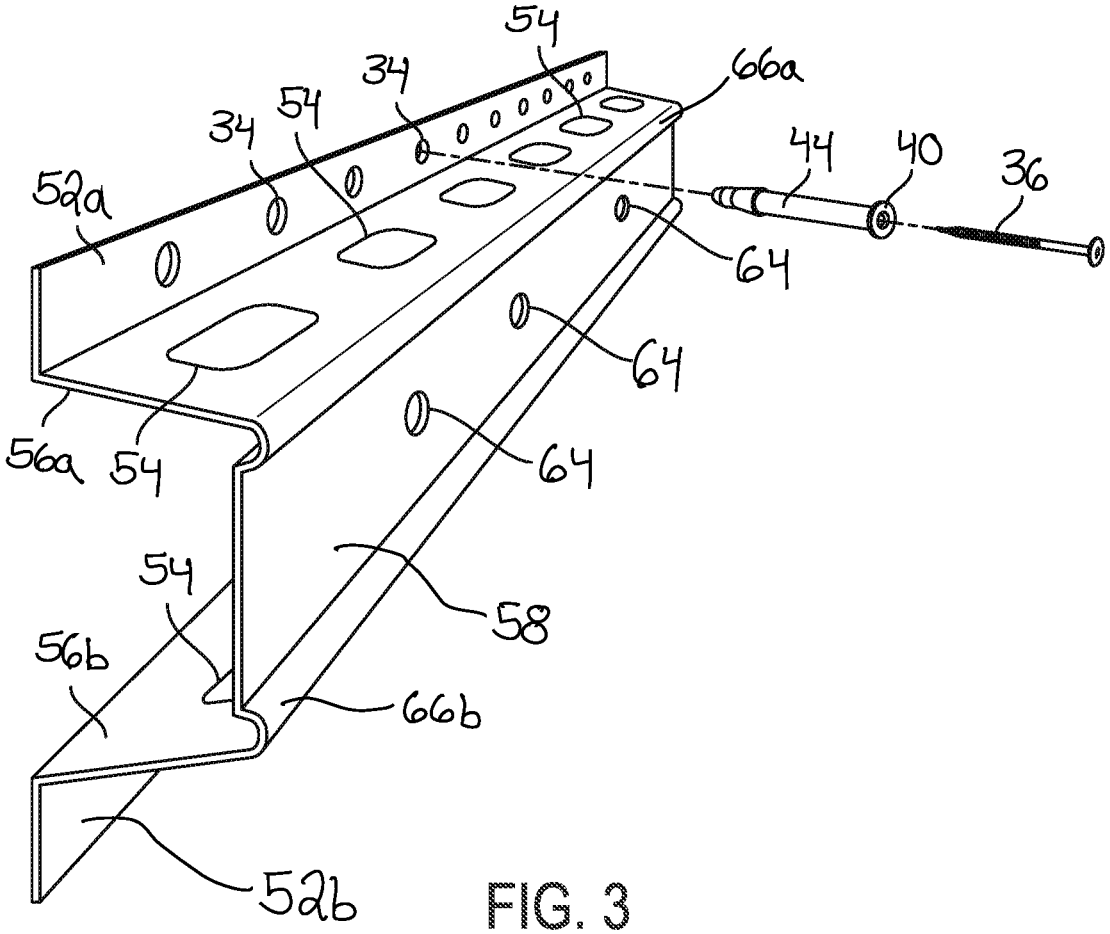
FIG. 3 is an exploded view of the wall fastener assembly and girt of FIG. 2.

As illustrated in FIGS. 2-3, wall fastener assembly 24 may be used for retaining an attachment, for example, a track of girt such as hat channel 20 that is used for furring out a wall and/or to create an insulative air gap between an exterior wall covering, such as an exterior rain cladding or a masonry veneer, and an inner wall such as wall system 22. Once shank 44 is aligned with mounting hole 34 of hat channel 20, and distal end 24*a* has been placed adjacent and/or proximate insulation layer 32 of wall system 22, screw 36 may be inserted into bore 38. Screw 36 may then be driven into wall system 22, thus causing distal end 24*a* to move in a distal direction to penetrate intermediate layers 60. Once screw end 36*a* has been driven into stud 28 a sufficient distance, distal end 24*a* presses into engagement with stud 28, and screw head 36*b* presses against flange 40 to tightly press flange 40 against mounting flange 36 of hat channel 30. Once both flange 40 and distal end 24*a* are bottomed-out, wall fastener assembly 24 will be affixed to wall system 10 in a secured position that also secures hat channel 20 alongside wall system 22. As discussed above, in the secured position, wall fastener assembly 24 forms a fluid-tight and/or vapor-tight seal with wall system 22. As shown in FIG. 4, in the secured position, screw head 36*b* is located externally outboard of wall fastener assembly 24, while screw end 36*a* is located internally outboard of wall fastener assembly 24.

Screw 36 may be driven into wall system 22 via any available driver means, such as an electric drill equipped with a screwdriver bit. Other means for driving screw 36 into wall system 22 may also be used. It is also noted that such an arrangement that makes use of a conventional screwdriver bit is an advantage over conventional wall anchors which often require the use of a proprietary chuck adapter that is configured to receive such wall anchors. Such an arrangement may also require the entire anchor to spin when the anchor is attached to a wall or substrate, thus potentially damaging portions of wall system 22, such as insulation layer 32 or gypsum layer 30.

Wall fastener assembly 24 is configured to reduce thermal transfer through wall system 22 at screw 36, with the materials for wall fastener assembly 24 being preferably chosen to maximize energy efficiency and reduce energy transfer. As such, the rigid material of shank 44 may be, for example, a resinous plastic, such as polycarbonate or a fiber reinforced plastic. Additionally, in an alternative embodiment, an O-ring, a gasket, or other sealing or crush ring (not shown) may optionally be disposed at distal side 40*b* of flange 40, where such a crush ring contacts and compresses against mounting flange 52*a* to further promote sealing between flange 40 and hat channel 20.

As previously noted, a wall fastener assembly may vary in a number ways depending on the unique characteristics of a wall system and/or an attachment being secured to a wall system. In this regard, a wall system may further include additional intermediate layers, or may have the same or similar intermediate layers as wall system 22, but arranged in a different order or being of varying thicknesses. For example, a layer of gypsum could be of a greater thickness than gypsum layer 30, in which case a sealing portion would be located further from a distal end of a wall fastener assembly to correspond with the location of a fluid barrier affixed to the external side of the gypsum layer, and the shank length would be increased to ensure the distal end and a flange each bottom-out after a screw has been driven into a supportive member a desired distance.

Figure 5:
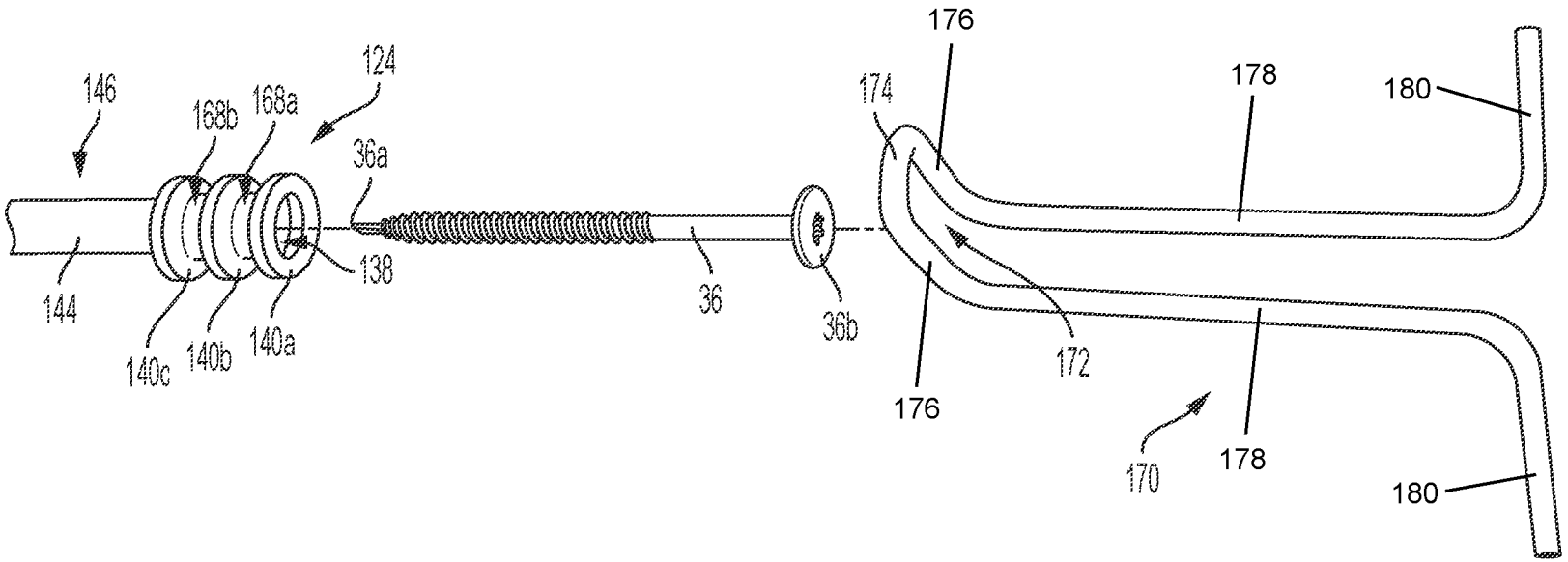
FIG. 5 is a perspective view of another wall fastener assembly in accordance with the present invention in which the wall fastener assembly includes flanges and grooves for selectively securing a masonry tie to the wall fastener assembly.
Figure 6:
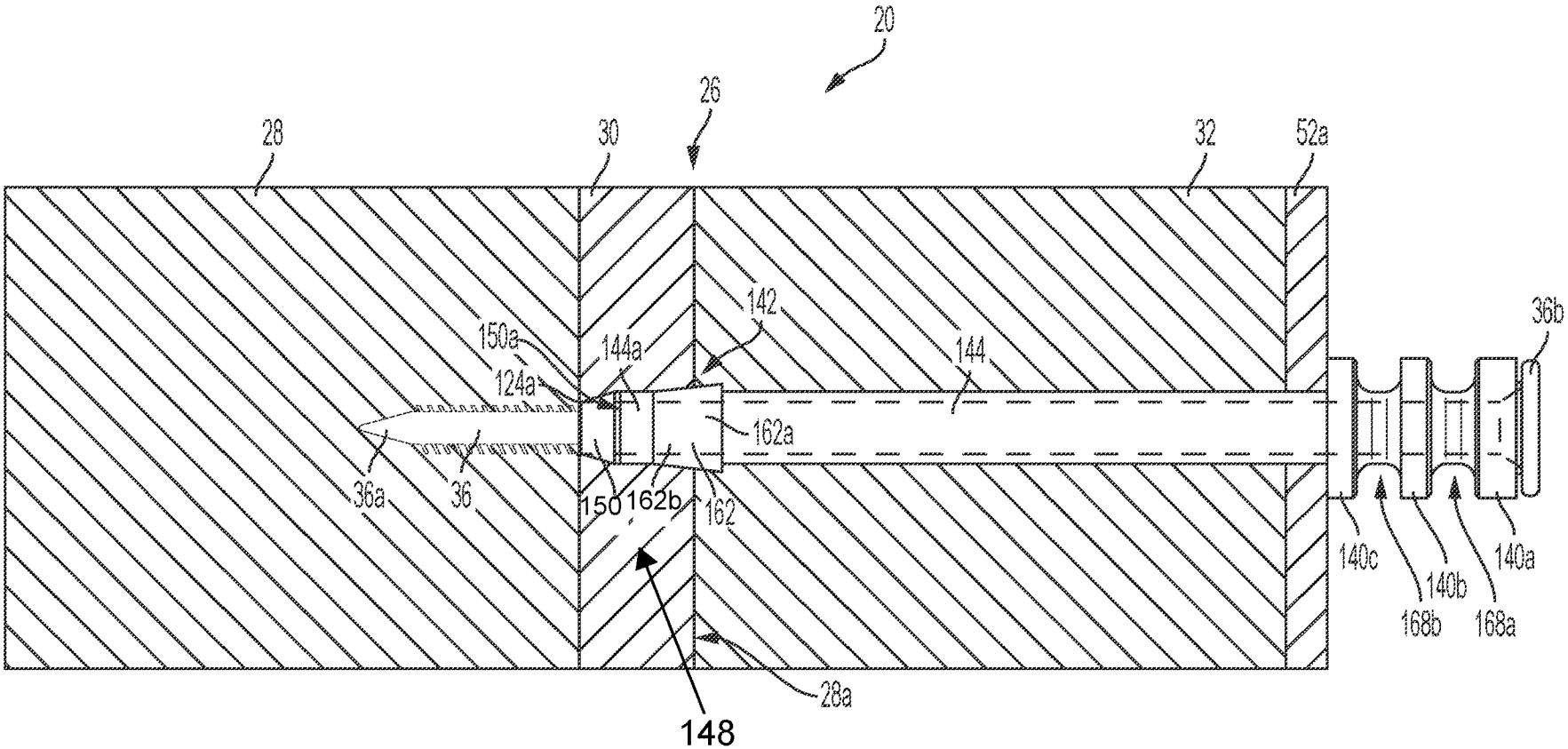
FIG. 6 is a cross sectional side elevation view of the wall fastener assembly of FIG. 5 in which the wall fastener assembly is shown securing a girt to a wall system.
Figure 7:
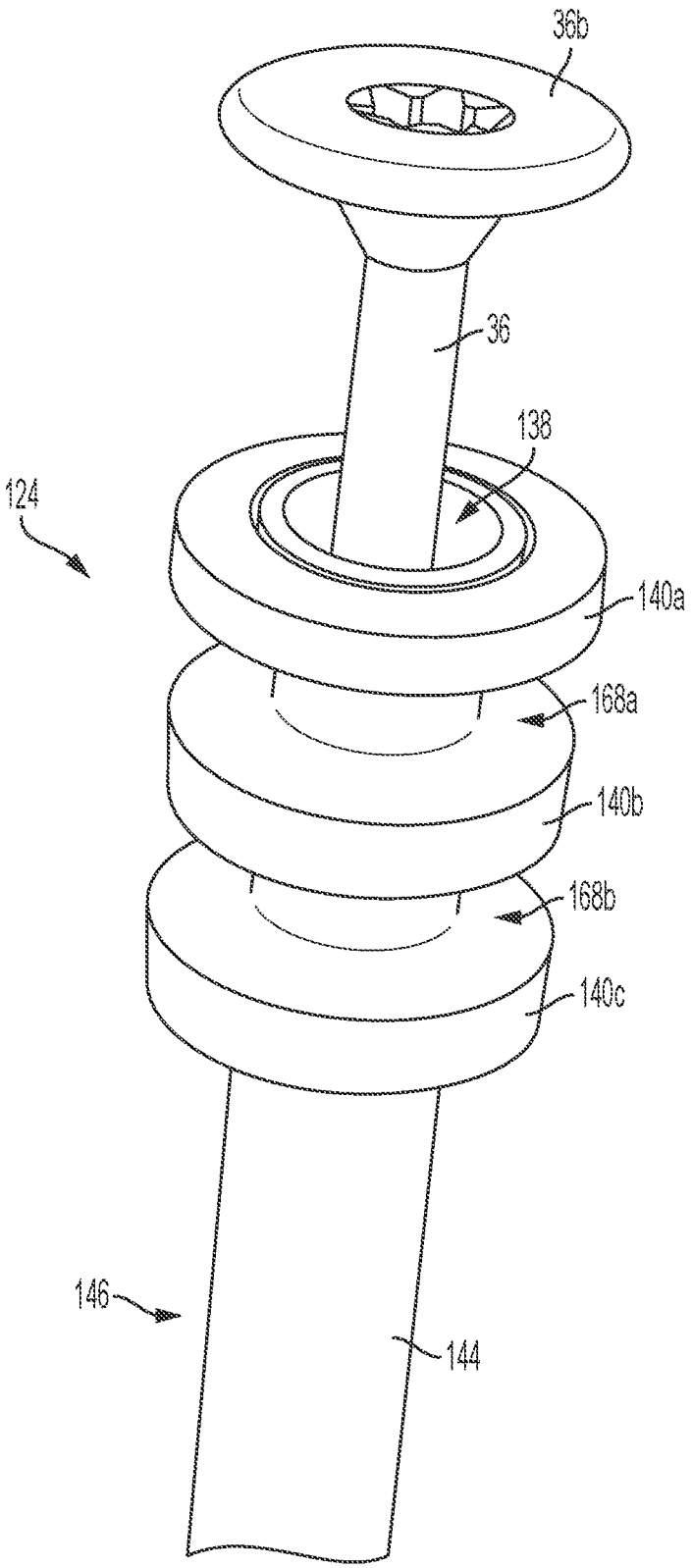
FIG. 7 is an enlarged perspective view of the wall fastener assembly of FIG. 5.

Referring now to the illustrated embodiment of FIGS. 5-7, another wall fastener assembly 124 is shown that is similar to wall fastener assembly 24, with similar features of wall fastener assembly 124 relative to wall fastener assembly 24 being designated with like reference numbers, but with "100" added to each reference number of wall fastener assembly 124. Due to the similarities of wall fastener assembly 124 relative to wall fastener assembly 24, not all of the components and features of wall fastener assembly 124 are discussed herein. As shown, wall fastener assembly 124 includes three flanges 140*a-c* that are spaced apart from one another by a pair of grooves 168*a*, 168*b*. Wall fastener assembly 124 further includes a proximal portion 146 and a distal portion 148, a shank 144 having a central bore 138 and a distal shank portion 144*a*, a sealing portion 142, a tapered portion 150 having a proximal end 150*a*, and a wedge seal 162 with a proximal wedge portion 162*a* and a distal wedge portion 162*b*.

A cladding anchor in the form of a masonry tie or wire tie 170 (FIG. 5) may be secured to wall fastener assembly 124 at either groove 168*a*, 168*b*. Wire tie 170 may then be secured to a masonry veneer or outer wall structure to thereby secure the masonry veneer to an internal wall structure, such as wall system 20, via wall fastener assembly 124. Wire tie 170 is formed from a single wire that is bent or formed to be generally L-shaped, and has an opening that forms a throat 172 between narrow, parallel portions 176. A U-shaped bend 174 is configured to nest or rest within either groove 168*a*, 168*b* between a pair of adjacent flanges 140*a-c* to thereby secure wire tie 170 to wall fastener assembly 124. A pair of perpendicular extension legs 178 extend substantially perpendicularly from each parallel leg portion 176 of narrow throat 172. Perpendicular tips 180 extend substantially perpendicularly from legs 178 and are oriented substantially coplanar with legs 178. While wire tie 170 in the exemplary embodiment is shown as a wire, it will be appreciated that a wire tie may have varying geometry, and that masonry or cladding anchors could take other forms as well, including pintles and plate anchors.

During construction, wire tie 170 may be slipped over and into either groove 168*a*, 168*b* with a single hand to thereby secure wire tie 170 to wall fastener assembly 124. Once secured to wall fastener assembly 124, portions of legs 178 and/or tips 180 may be disposed in a wet mortar joint between two rows of bricks or the like of an outer structure or masonry veneer. Wire tie 170 may also be rotated or moved approximately 1.25 inches above or 1.25 inches below head 36*b* of screw 36, thus ensuring that wire tie 170 can be properly placed into a wet mortar joint while wire tie 170 remains secured to wall fastener assembly 124. In addition to being secured to wall fastener assembly 124, once the wet mortar cures and/or hardens around portions of legs 178 and/or tips 180, wire tie 170 becomes more fully secured to the masonry veneer. Accordingly, the masonry veneer becomes secured to an inner wall structure such as wall system 20 via engagement of wall fastener assembly 124 with wall system 20 and wire tie 170 with wall fastener 124. Additionally, extension legs 178 of wire tie 170 allows for the securement of the masonry veneer to wall system 20 while also leaving an insulative air gap between the masonry veneer and wall system 20. Accordingly, an outer masonry veneer may be secured to an inner wall structure via multiple wall fastener assemblies 124 disposed at locations corresponding to supportive members or structures, for example stud 28 of wall system 20, and a mortar joint of the masonry veneer.

Extension legs 178 are configured to extend from narrow throat 172 toward the masonry veneer when wire tie 170 is mounted to wall fastener assembly 124 such that portions of legs 178 and/or tips 180 are disposed in and coplanar with a mortar joint. Extension legs 178 have an extension length defined from narrow throat 172 to tips 180. The extension length may be chosen as a function of various factors, including the width of the masonry veneer and the desired penetration of wire tie 170 into the masonry veneer, as well as the desired air gap between the masonry veneer and wall system 20. In this regard, the multiple flanges 140*a-c* of wall fastener assembly 124 enable wire tie 170 to be secured to wall fastener assembly 124 at either groove 168*a*, 168*b* as desired, for example, to accommodate the width of the masonry veneer and/or air gap between the masonry veneer and an inner wall. Additionally, wall fastener assembly 124 may also better accommodate masonry ties of different lengths, shapes, and/or sizes due to wall fastener assembly 124 having multiple locations at which a masonry tie may be secured. It should be appreciated that a wall fastener assembly may have additional flanges and grooves to allow for further locations at which a masonry tie or the like may be secured to the wall fastener assembly. Furthermore, a wall fastener assembly may have flanges and/or grooves that are larger or smaller apart from what is shown in the illustrated embodiment.

Figure 8:
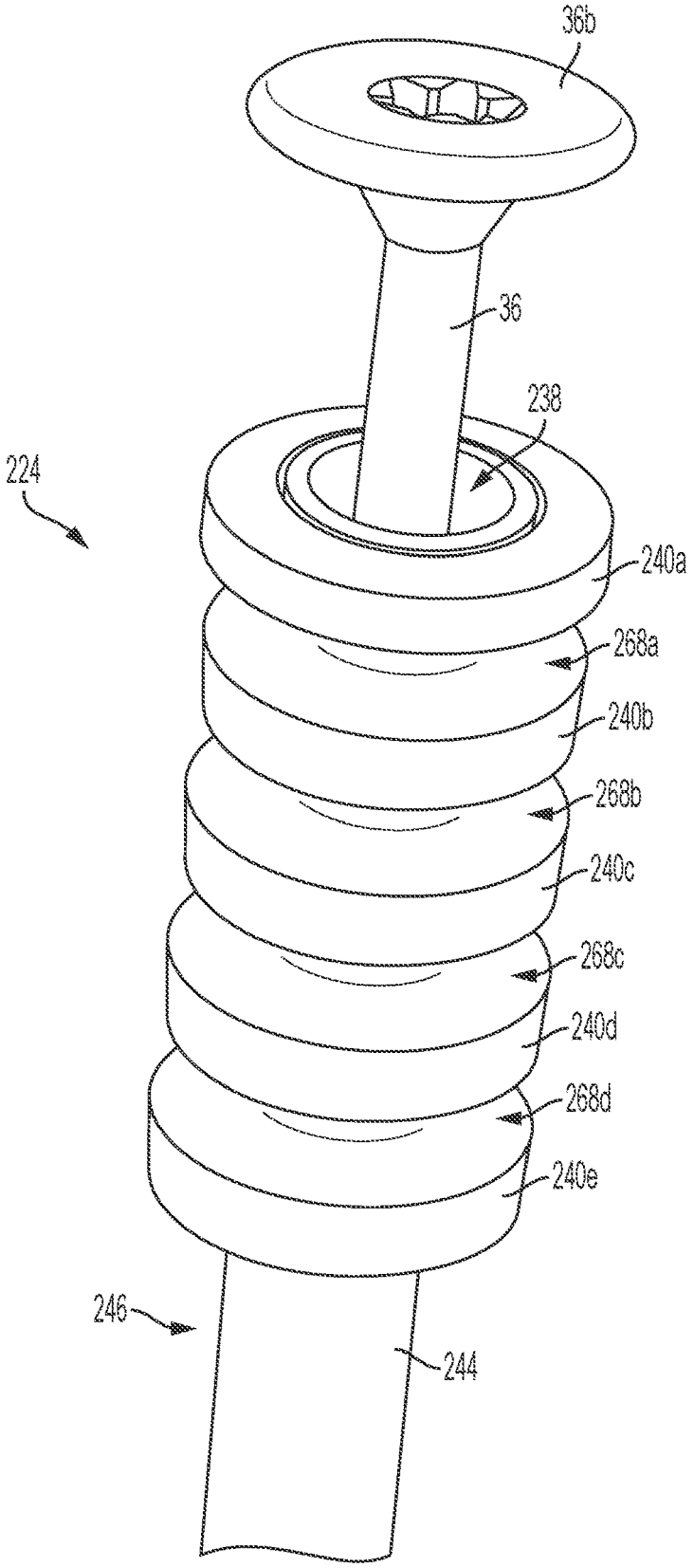
FIG. 8 is an enlarged perspective view of another wall fastener assembly in accordance with the present invention in which the wall fastener assembly includes multiple flanges and grooves for selectively securing an anchor plate to the wall fastener assembly.

Referring now to the illustrated embodiment of FIG. 8, another wall fastener assembly 224 is shown that is similar to wall fastener assembly 24, with similar features of wall fastener assembly 224 relative to wall fastener assembly 24 being designated with like reference numbers, but with "200" added to each reference number of wall fastener assembly 224. Due to the similarities of wall fastener assembly 224 relative to wall fastener assembly 24, not all of the components and features of wall fastener assembly 224 are discussed herein. As shown, wall fastener assembly 224 includes additional flanges that are spaced closer to one another as compared to flanges 140*a-c* of wall fastener assembly 124 discussed above. In particular, wall fastener assembly 224 includes five flanges 240*a-e* that are spaced apart from one another by four grooves 268*a-d*. Wall fastener assembly 224 further includes a proximal portion 246, a distal portion, and a shank 244 having a central bore 238. Additionally, although not visible in the illustrated embodiment of FIG. 8, wall fastener assembly 224 also includes many features that are similar or identical to that of wall fastener assemblies 24 and 124, including a sealing portion, a tapered portion, and a wedge seal.

Figure 9:
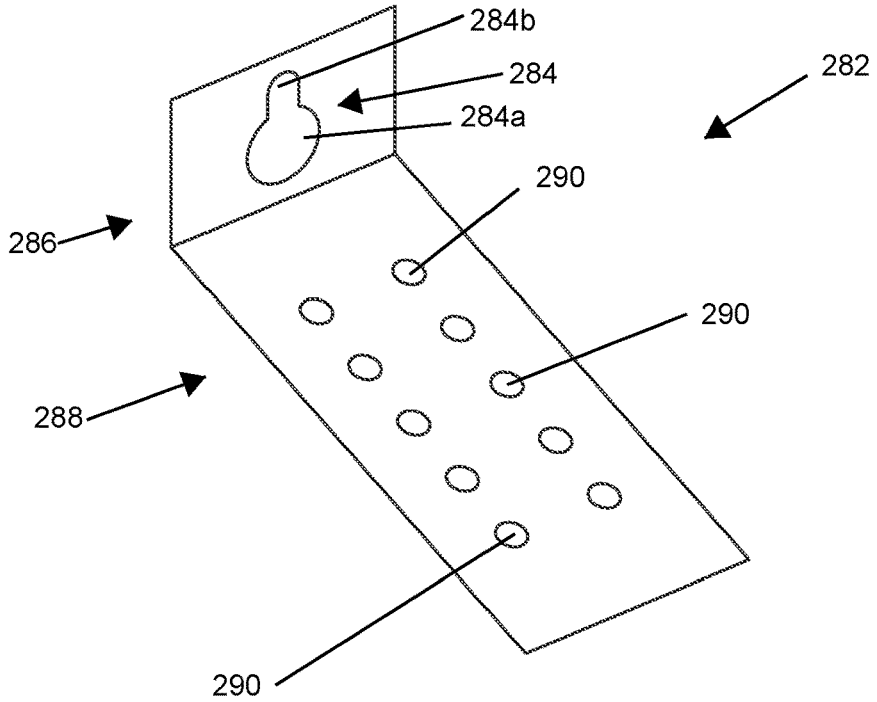
FIG. 9 is a perspective view of an anchor plate in the form of a bent anchor plate defining a series of holes.

Like wall fastener assembly 124, wall fastener assembly 224 may be used to secure a masonry anchor to an internal wall structure, where the anchor is also securable to an outer masonry veneer or wall structure to thereby secure the masonry veneer to the internal wall structure. For example, a masonry anchor in the form of a plate anchor, such as plate anchor 282 (FIG. 9), may be secured to wall fastener assembly 224. Plate anchor 282 is constructed of a stamped and bent plate or sheet member, and includes a slotted or tear-shaped key hole opening 284 at an inner securing portion 286. Opening 284 has a large opening area 284*a* that is larger in diameter than any one of flanges 240*a-e*, and a small opening area 284*b* that is smaller in diameter than any one of flanges 240*a-e*. An outer securing portion 288 is oriented at an angle to inner securing portion 286, and defines a series of through holes 290.

Plate anchor 282 may be secured to wall fastener assembly 224 at any one of grooves 268*a-d* by sliding large opening area 284*a* over one or more flanges 240*a-e*, and then allowing small opening area 284*b* to rest or become nested/secured at one of grooves 268*a-d*. After plate anchor 282 is secured to wall fastener assembly 224 at a desired groove 268*a-d*, outer securing portion 288 may then be positioned in a mortar joint, such as a mortar joint between one or more adjacent stones or rocks. Once positioned in the mortar joint, wet mortar may ooze or otherwise move through one or more holes 290. Plate anchor 282 becomes more fully secured to the masonry veneer as the mortar cures and/or hardens around at least a portion of outer securing portion 288. Once plate anchor 282 is secured to both wall fastener assembly 224 and the masonry veneer, the masonry veneer will be secured to an inner wall structure, such as wall system 20, via plate anchor 282 and wall fastener assembly 224. Additionally, because wall fastener assembly 224 provides multiple flanges and grooves, plate anchor 282 may be selectively secured to wall fastener assembly 224 at any groove 268*a-d* as desired, for example, to accommodate the width of the masonry veneer and/or air gap between the masonry veneer and an inner wall. Additionally, the multiple securing locations for a cladding anchor provided by wall fastener assembly 224 allows wall fastener assembly 224 to accommodate other cladding anchors having alternative shapes and sizes.

Figure 10:
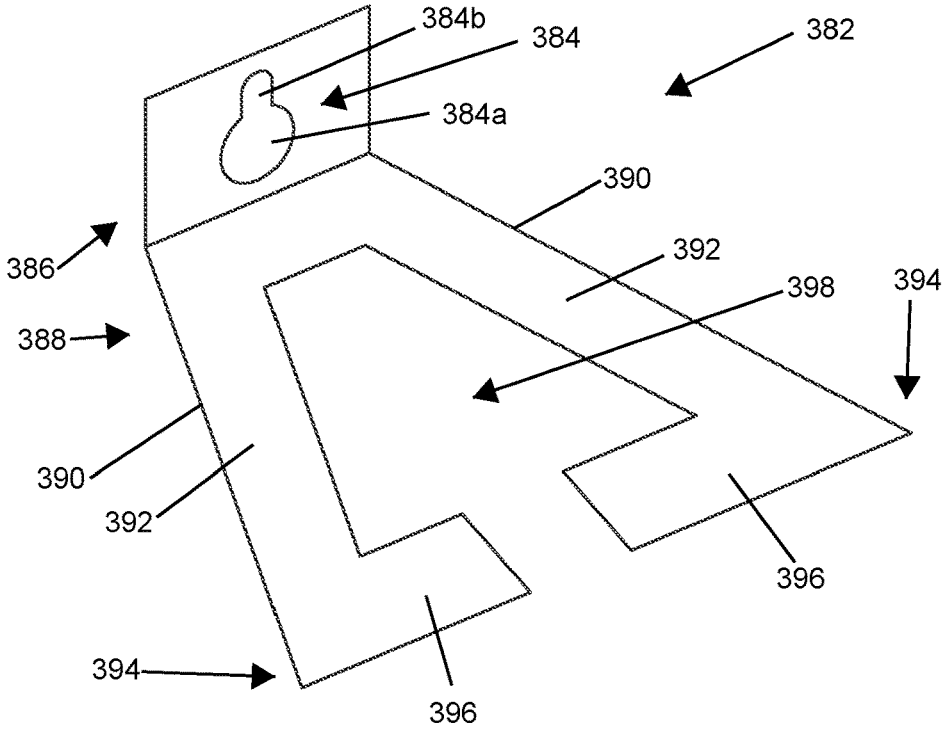
FIG. 10 is a perspective view of another anchor plate in the form of a bent anchor plate with legs that define an inner open area.

With reference to FIG. 10, an alternative plate anchor in the form of V-shaped plate anchor 382 could be used in a similar fashion as plate anchor 282 for securing an outer wall or masonry veneer to an internal wall structure via a wall fastener assembly, such as wall fastener assembly 224. Plate anchor 382 may also be constructed of a stamped and bent plate or sheet member, and also includes a slotted or tear-shaped key hole opening 384 at an inner securing portion 386. Opening 384 has a large opening area 384*a* that is larger in diameter than any one of flanges 240*a-e*, and a small opening area 384*b* that is smaller in diameter than any one of flanges 240*a-e*. An outer securing portion 388 is oriented at an angle to inner securing portion 386, and includes a pair of spaced apart legs 390 that are angled away from one another as each leg 390 extends away from inner securing portion 386. Each leg 390 includes an extension portion 392 that is connected to an elbow, hook, or bend 394, and terminates at an end portion 396 that is angled relative to extension portion 392. As shown in FIG. 10, legs 390 are shaped to form or partially define an inner open area 398.

Inner securing portion 386 of plate anchor 382 may be secured to wall fastener assembly 224 at any one of grooves 268*a-d* in a similar or identical fashion as described above with regard to plate anchor 282. Outer securing portion 388 of plate anchor 382 may also be secured at a mortar joint of a masonry veneer in a similar fashion to outer securing portion 288 of plate anchor 282 described above. However, rather than oozing or moving through a series of holes, wet mortar moves through inner open area 398 before curing and/or hardening to thereby secure outer securing area 388 at the mortar joint, and thus securing the masonry veneer to an internal wall structure via plate anchor 382 and wall fastener assembly 224. It should be appreciated that a cladding anchor may take alternative forms apart from what has been described above.

Changes and modifications in the specifically described embodiments can be carried out without departing from the principles of the present invention which is intended to be limited only by the scope of the appended claims, as interpreted according to the principles of patent law including the doctrine of equivalents.

The invention claimed is:

1. A wall system, said wall system comprising:

a wall fastener assembly comprising a unitary, non-metallic elongated shank and a threaded fastener that is longer than said shank, wherein said threaded fastener includes a head and a threaded end opposite said head, and wherein said shank includes a flange located at a proximal portion, a center bore extending along a length of said shank through which said threaded fastener is disposed, and a distal end opposite said flange, and wherein said shank defines a solid wall about said center bore;

an internal supportive wall member comprising a substrate;

at least one intermediate layer, said at least one intermediate layer comprising an insulation layer;

a wall attachment, said wall attachment including a mounting hole;

wherein said wall fastener assembly is disposed through said mounting hole of said wall attachment with said threaded end of said threaded fastener engaged with said substrate and said distal end of said shank pressed against said substrate to form a seal, and with said at least one intermediate layer disposed between said substrate and said wall attachment;

wherein said shank provides a space for said at least one intermediate wall layer between said substrate and said wall attachment; and wherein said flange engages with said wall attachment at said mounting hole.

2. The wall system of claim 1, wherein said head of said threaded fastener engages with said flange on an opposite side of said flange from the engagement of said flange with said wall attachment.

3. The wall system of claim 1, wherein said shank includes at least one additional flange, and wherein adjacent pairs of said flanges are spaced apart by a groove disposed therebetween.

4. The wall system of claim 1, wherein said distal end of said shank forms a seal against said substrate.

5. The wall system of claim 1, wherein said shank defines an axial portion having an outer shank diameter and further comprises a sealing portion on said axial portion that is unitarily formed with said shank and defines a diameter that is greater than said outer shank diameter.

6. The wall system of claim 5, wherein said at least one intermediate layer further comprises a weather barrier sheet and an internal wall layer, wherein said weather barrier sheet is disposed between said insulation layer and said internal wall layer and said internal wall layer is disposed between said substrate and said weather barrier sheet, and wherein said sealing member is disposed at the weather barrier sheet when said threaded fastener has secured said wall fastener assembly to said substrate.

7. The wall system of claim 6, wherein said sealing portion comprises a tapered wedge seal having a proximal wedge portion with a proximal wedge diameter that is larger than said outer diameter of said shank, wherein said wedge seal extends circumferentially around said shank.

8. The wall system of claim 7, wherein said tapered wedge seal further comprises a distal wedge portion, and wherein when said wall fastener assembly is secured to the substrate, said proximal wedge portion is located on an external side of said weather barrier sheet, and said distal wedge portion is located on an internal side of said barrier sheet.

9. The wall system of claim 5, wherein said sealing portion comprises a frustoconical-shaped portion.

10. The wall system of claim 1, wherein said wall attachment is a girt channel having a mounting flange that includes said mounting hole.

11. The wall system of claim 10, wherein a length of said shank is substantially equivalent to the combined thickness of said mounting flange, said insulation layer, said weather barrier sheet, and said internal wall layer.

12. The wall system of claim 10, wherein said girt channel comprises a hat channel and includes another said mounting flange, and wherein said another mounting flange comprises a mounting hole for receiving another said wall fastener assembly.

13. The wall system of claim 1, wherein said shank has a tapered shaft portion terminating at said distal end.

14. The wall system of claim 1, wherein said substrate comprises a stud.

* * * * *